US012514407B1

(12) United States Patent
Bilderback

(10) Patent No.: US 12,514,407 B1
(45) Date of Patent: Jan. 6, 2026

(54) PORTABLE FOOT WASHER

(71) Applicant: John Bilderback, Haleiwa, HI (US)

(72) Inventor: John Bilderback, Haleiwa, HI (US)

( * ) Notice: Subject to any disclaimer, the term of this patent is extended or adjusted under 35 U.S.C. 154(b) by 0 days.

(21) Appl. No.: 19/179,285

(22) Filed: Apr. 15, 2025

(51) Int. Cl.
*A47K 3/022* (2006.01)

(52) U.S. Cl.
CPC ..... *A47K 3/022* (2013.01)

(58) Field of Classification Search
CPC ..... A47K 3/022
See application file for complete search history.

(56) References Cited

U.S. PATENT DOCUMENTS 5,367,720 A * 11/1994 Stephens ..... A47K 3/022 4/615
5,588,161 A * 12/1996 Barradas ..... A61H 35/006 4/662
6,931,675 B1 * 8/2005 Hager ..... A47K 3/022 4/622
2010/0299828 A1 * 12/2010 Shapiro ..... A47K 3/022 4/622

* cited by examiner

*Primary Examiner* — Janie M Loeppke
(74) *Attorney, Agent, or Firm* — Plager Schack LLP; Mark H. Plager; Naomi Mann

(57) ABSTRACT

A portable foot washer is configured to wash a user's foot via a mechanically created rinse spray, and may comprise a reservoir and a spring supported footbed housed within the reservoir.

7 Claims, 5 Drawing Sheets

PORTABLE FOOT WASHER

BACKGROUND

The present disclosure relates generally to foot washing systems and devices.

Beachgoers often desire to remove sand from their feet before stepping into a car, home, or other location. Typically, a faucet or hose supplying fresh water may be used when bathing is not a practical option. This may waste water, or may not be available right where or when needed (e.g., just before stepping into the car). As such, an improved foot washing system that addresses the above-mentioned deficiencies is desirable.

SUMMARY

According to various embodiments, disclosed is a foot washing system providing a portable foot washer which may comprise a reservoir including a reservoir floor and a surrounding side wall extending upwards from the reservoir floor and forming an enclosure configured to hold a liquid; a top wall extending into the reservoir enclosure past an inner top edge of the surrounding side wall of the reservoir, the top wall including an opening through which a user's foot can be inserted into the reservoir; and a spring supported footbed housed within the enclosure of the reservoir and configured to receive said user's foot. In some embodiments, a narrow gap is provided between a surrounding side wall of the footbed and the surrounding side wall of the reservoir such that, when pressed down by the user's foot, the footbed is configured to impose pressure on liquid contained within the reservoir, forcing the liquid through the narrow gap, such that said liquid hits an underside of the top wall extending into the reservoir enclosure and is directed back down on the user's foot which is positioned atop the footbed. In some embodiments, the underside of the top wall has a curvature for directing water downwards. In some embodiments, the top wall is provided within a removable top rim configured to cap the reservoir, the top rim providing a top opening for receiving the user's foot. In some embodiments, the foot washer further comprises a drain floor including a drain floor opening, the drain floor being supported atop the reservoir floor and configured to trap particles contained in liquid within the reservoir.

BRIEF DESCRIPTION OF THE FIGURES

The detailed description of some embodiments of the invention will be made below with reference to the accompanying figures, wherein the figures disclose one or more embodiments of the present invention.

DETAILED DESCRIPTION OF CERTAIN EMBODIMENTS

Figure 1:
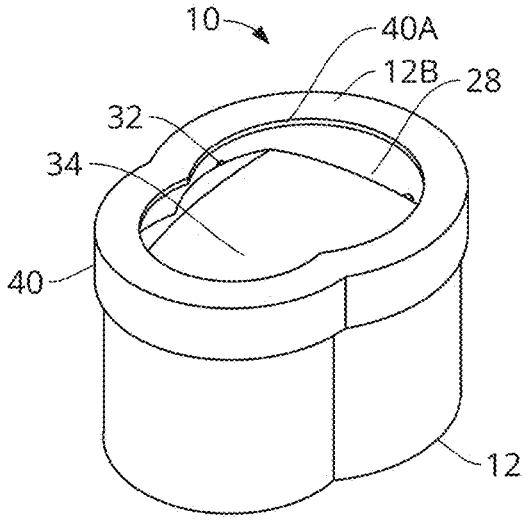
FIG. 1 is a perspective view of a portable foot washer, according to certain embodiments.
Figure 2:
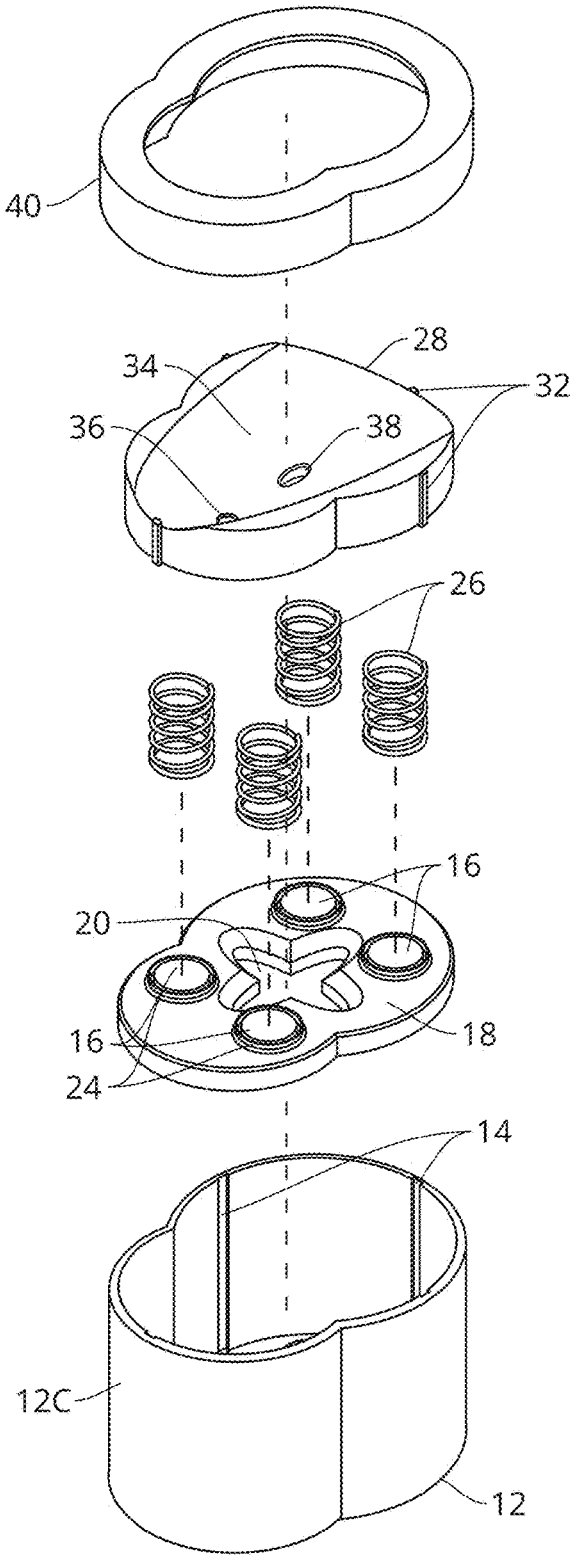
FIG. 2 is a top perspective exploded view of the foot washer, including a reservoir, drain floor, footbed, and springs, and top rim attachment, according to certain embodiments.
Figure 3:
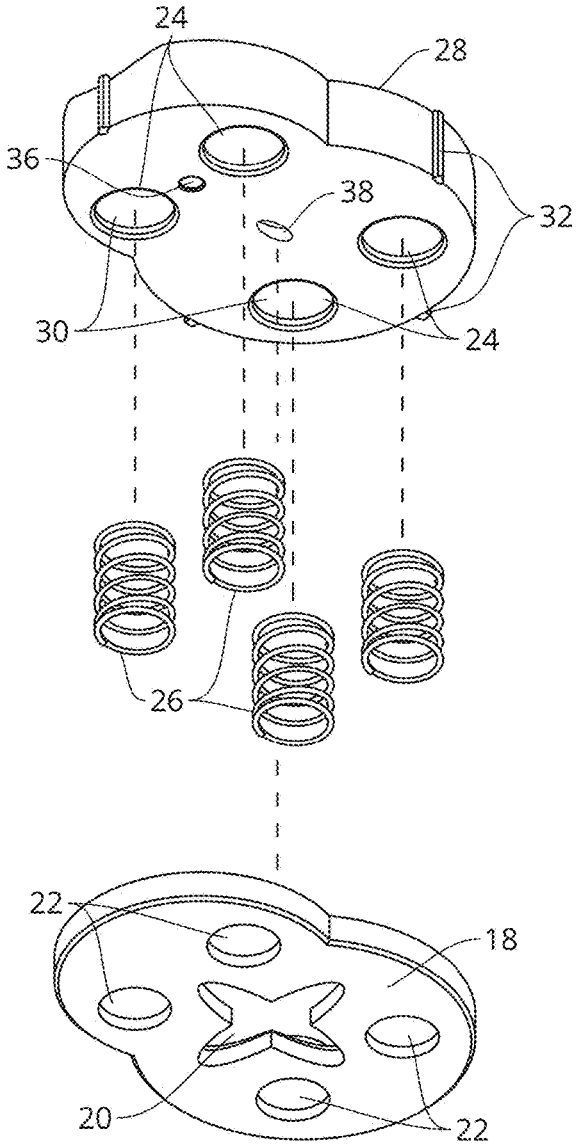
FIG. 3 is a bottom perspective exploded view of the drain floor, footbed, and springs, according to certain embodiments.
Figure 4:
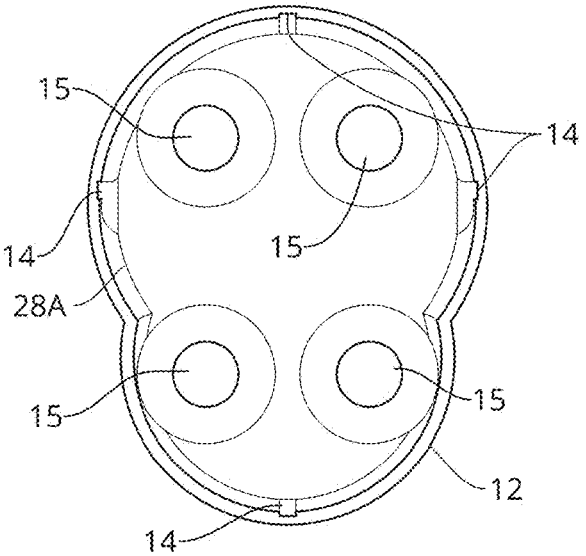
FIG. 4 is a top view of the reservoir of the foot washer according to certain embodiments.
Figure 5:
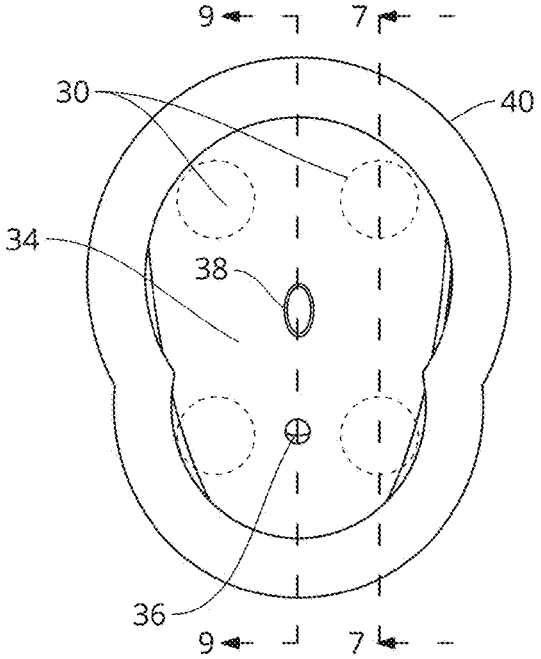
FIG. 5 is a top view of the foot washer.
Figure 6:
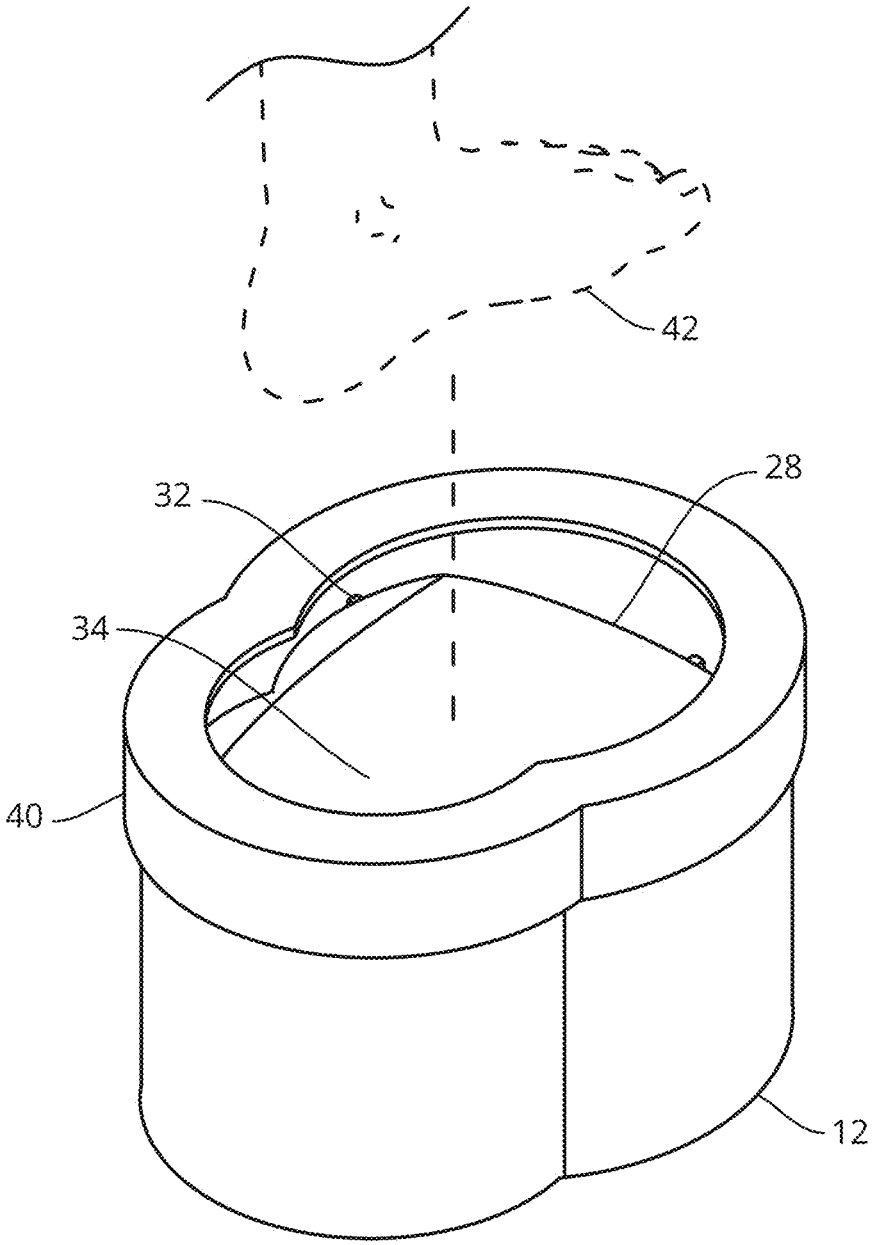
FIG. 6 is a perspective illustrating the insertion of a foot into the foot washer.
Figure 7:
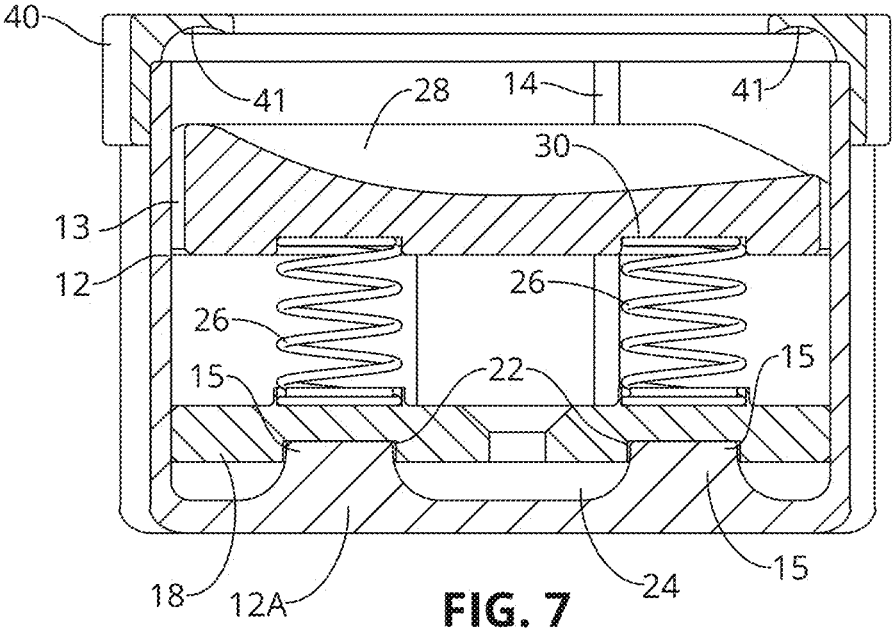
FIG. 7 is a section view taken along line 7-7 in FIG. 5
Figure 8:
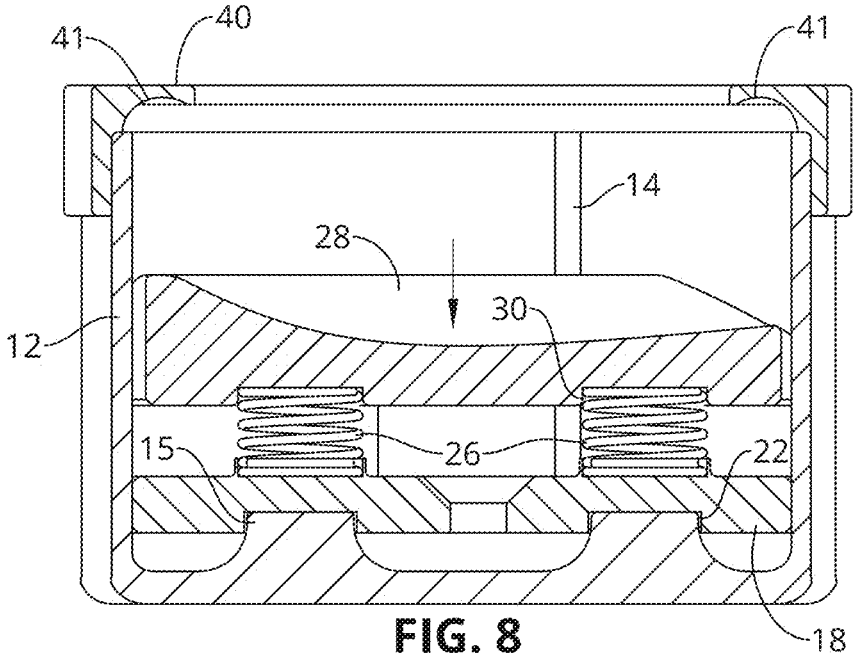
FIG. 8 is a section view similar to that of FIG. 7, showing compression of the footbed.
Figure 9:
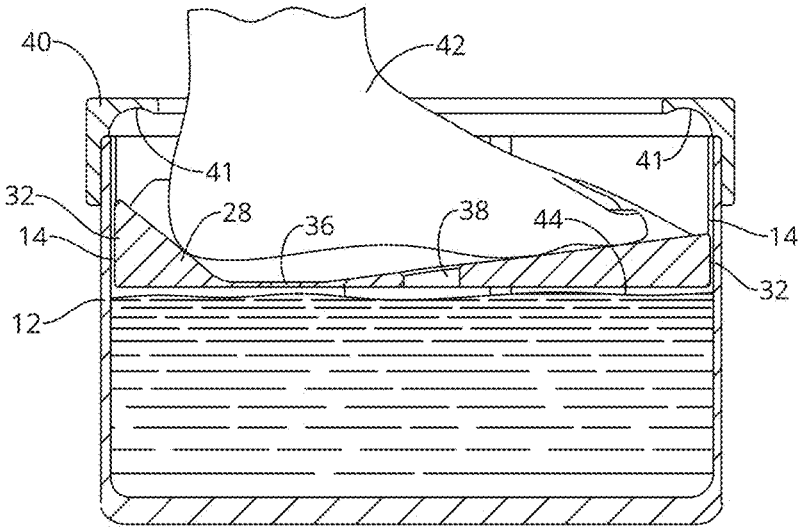
FIG. 9 is a section view taken along line 9-9 in FIG. 5 showing a user's foot in place with water in the reservoir.
Figure 10:
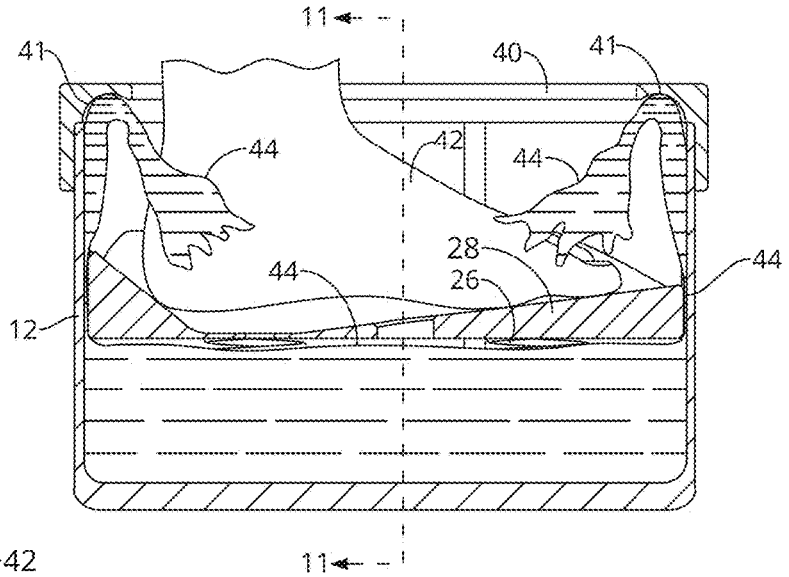
FIG. 10 is a section view similar to that of FIG. 9, illustrating forcing of the water around the footbed to be deflected onto the user's foot.
Figure 11:
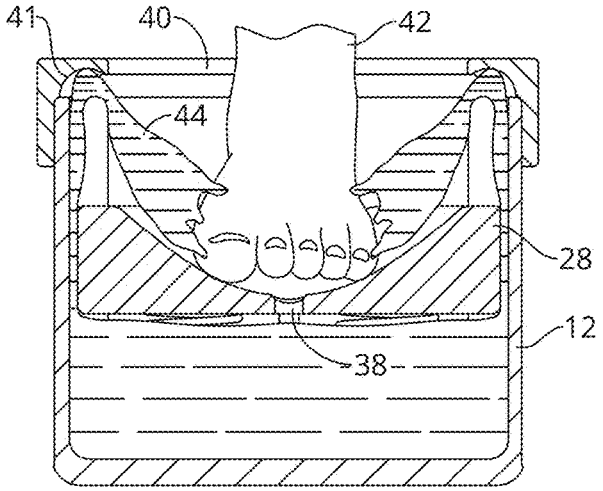
FIG. 11 is a section view taken along line 11-11 in FIG. 10, illustrating submergence of the foot.

According to various embodiments as depicted in FIGS. 1-8, disclosed is a portable foot washer 10 for effectively washing a user's foot 42 using a mechanically created rinse spray as well as submergence of the foot. In certain embodiments, foot washer 10 may comprise a reservoir 12, and a spring supported footbed 28 housed within reservoir. Reservoir 12 generally comprises a bottom floor 12A (also referred to as "reservoir floor 12A") and a surrounding side wall 12C extending vertically upwards from bottom floor 12A to form an enclosure configured to hold a foot rinse liquid 44, e.g., water and/or soapy water and to receive user's foot 42. In some embodiments, reservoir 12 includes a top wall 12B extending into the reservoir enclosure over the top edge the surrounding side wall 12C. In certain embodiments, spring supported footbed 28 is configured to create a water/liquid jet in foot washer device 10 when pressed or pumped down by the foot. Thereby, the liquid may hit the underside of top wall 12B and is forced back down into the reservoir. In some embodiments, top wall 12B may be provided with a curved underside 41 configured to direct the water jet towards user's foot 42. In some embodiments, top wall 12B may be incorporated into a removable top rim 40, which caps reservoir 12 and provides a top opening in foot washer 10 for receiving foot 42. In further embodiments, foot washer 10 may comprise a drain floor 18 supported atop bottom floor 12A of reservoir 12. Drain floor 18 may be configured to capture sand, gravel, and other such particles between bottom floor 12A and drain floor 18.

In embodiments, footbed 28 is generally configured to allow a user to press or pump down against liquid 44 with his/her foot 42. In doing so, user's foot 42 submerges inside liquid 44 contained in reservoir 12, while at the same time, liquid 44 is caused to spray downwards onto foot 42 at a high pressure to effectively clean the foot from debris such as sticky sand that stubbornly clings to the foot and is not easily removable with submersion.

In certain embodiments, footbed 28 may include a first drain hole 36 configured to prevent water from collecting on top of the footbed. In further embodiments, footbed 28 also includes a curved top surface 34 configured to direct water towards first drain hole 36. In one embodiment, curved top surface 34 provides a valley which slopes into a central depression that includes a first drain hole 36 at the lowest point of the central depression. In some embodiments, a second drain hole 38 may further be provided upwards of first drain hole 36 as depicted, for more effective water drainage. Additionally, as depicted, footbed 28 slops downwards and narrows from a back foot section to a front foot section, for guiding correct positioning of foot 42. It shall be appreciated that any number of drain holes may be provided in alternate embodiments.

In some embodiments, a plurality of springs 26 are captured between an underside of footbed 28 and drain floor 16 via spring retaining members 24. In one embodiment, said spring retaining members 24 may comprise spring receiving slots 30 formed at the underside of footbed 28, and spring posts 16 formed atop drain floor 18, wherein spring receiving slots 30 are configured to receive the top of each spring, and spring posts 16 are received within the bottom of each spring. In one embodiment, foot washer device 10 may comprise 4 springs which are evenly distributed, i.e., in a quadrilateral configuration as depicted, to evenly balance the force imposed on footbed 28 by the user's foot. It shall be appreciated however, that a different number of springs and/or different types of spring retaining members may be used in alternate embodiments. In some further embodiments, the surrounding side wall of footbed 28 includes vertical ridges 32 configured to engage within guide channels 14 provided on an inner surface of the reservoir surrounding side wall 12C. In one embodiment, footbed 28 may include 4 vertical ridges 32 including a front ridge, a back ridge and two side ridges as depicted. As such, a user may place his/her foot on the footbed and push downwards against springs 26, whereby guide channels 14 and balanced distribution of springs 26 maintain a planar alignment of footbed 28 with respect to reservoir floor 12A as it moves up and down. Furthermore, footbed 28 is sized to provide a narrow gap 13 between its side wall 28A and the opposing inner surface of the reservoir surrounding side wall 12C. This forces fluid 44 through gap 33 with increased velocity. The fluid forced through gap 33 jets upwards and hits curved underside 41, and is then directed back on user's foot 44. In certain embodiments, washer device 10 may be provided with a removable top rim 40 which fits and/or clips to the top of reservoir 12. In embodiments, top rim 40 incorporates curved underside 41 and provides a foot receiving opening 40A in its top wall 40B which extends into reservoir 12 past side wall 12C of the reservoir. In certain embodiments, as depicted in the figures, curved underside may have a circular or concaved profile for directing the liquid downwards and towards the footbed.

In further embodiments embodiment, drain floor 18 may be supported atop reservoir floor 12A via raised posts 15 in reservoir floor 12A that mate within cylindrical hollows 22 formed at the underside of spring posts 16, the spring posts 16 being shelled cylindrical bodies which are raised from a top surface of drain floor 18. Additionally, a drain floor opening 20 is provided within drain floor 18. As such, drain floor 18 is held in place via raised posts 15 in reservoir floor 12A and is configured to capture sand at the bottom of the reservoir. The sand is mixed with liquid 44 and enters through opening 20, wherein the heavier particles are inclined to become trapped between drain floor 18 and reservoir floor 12A. In some embodiments, drain floor opening 20 may be centered about drain floor 18. In one embodiment, drain floor opening 20 includes a cross configuration as depicted. It shall be appreciated however, that different configurations may be employed in alternate embodiments, and that more than one drain floor opening 20 may be provided in alternate embodiments.

In use, reservoir 12 is filled with rinse liquid 44, a user may insert his/her foot 42 into reservoir 12 and place it on top of footbed 28. The user may then press or pump down on footbed 28 to push against liquid 44. This forces liquid 44 through narrow gap 13, wherein the constricted space of the gap causes some of liquid 44 to forcefully jet upwards and hit against curved underside 41, whereby it sprays down against foot 42. At the same time foot 42 is submerged in liquid 44 within reservoir 12. Additionally, drain floor 18 is configured to allow liquid 44 which may be mixed with sand to freely pass through drain floor opening 20 whereby the heavy sand particles in the liquid may be captured within the space between drain floor 18 and reservoir floor 12A. As sch, drain floor 18 allows sand to be collected beneath it, so that it's prevented from mixing with the rinse liquid. As drain floor 18 is removable, it can easily be disassembled from reservoir 12, so that the collected sand can be removed.

Hence, foot washer 10 provides a portable and self-contained device which can be used at beaches, camp grounds, play areas, etc. for conveniently washing feet including removing sand. Additionally, foot washer 10 can reuse water and is foot powered, thus it saves both water and electricity. Foot washer device 10 is easily portable, and can be placed at any location, including by a pool, car, an entrance to a home, hotel, or store, etc. While foot washer 10 may ideally be filled with fresh or soapy rinse water, it can also be filled with ocean or river water when a clean water supply is not available.

It shall be appreciated that foot washer 10 and/or components of foot washer 10 may have different configurations in alternate embodiments. For example, a number of springs and/or different spring retaining components may be used in alternate embodiments. Additionally, while foot washer 10 is depicted has a having a wide circular back foot section and a narrower front foot section, other geometric shapes may be used in alternate embodiments without departing from the inventive concept. In other alternate embodiments, drain floor 18 may be omitted and/or top rim 40 may be formed continues with reservoir instead of being a separate component. Furthermore, it shall be appreciated that foot washer 10 may be adapted for other uses, such as rinsing off foot ware, including reef walkers, beach shoes, sandals, rain boots, etc., in alternate embodiments.

It shall be appreciated that the components foot washer 10 may comprise any alternative known materials in the field and be of any size and/or dimensions. It shall be appreciated that the components of foot washer 10 may be manufactured and assembled using any known techniques in the field.

It shall be understood that the orientation or positional relationship indicated by terms such as "upper", "lower", "front", "rear", "left", "right", "top", "bottom", "inside", "outside" is based on the orientation or positional relationship shown in the accompanying drawings, which is only for convenience and simplification of describing the disclosed subject matter, rather than indicating or implying that the indicated device or element must have a specific orientation or are constructed and operated in a specific orientation, and therefore should not be construed as a limitation of the present invention.

As used herein, the articles "a" and "an" are intended to include one or more items, and may be used interchangeably with "one or more." Where only one item is intended, the term "one" or similar language is used. Also, as used herein, the terms "has", "have", "having", "with" or the like are intended to be open-ended terms. Further, the phrase "based on" is intended to mean "based, at least in part, on" unless explicitly stated otherwise.

The constituent elements of the disclosed device and system listed herein are intended to be exemplary only, and it is not intended that this list be used to limit the device of the present application to just these elements. Persons having ordinary skill in the art relevant to the present disclosure may understand there to be equivalent elements that may be substituted within the present disclosure without changing the essential function or operation of the device. Terms such as 'approximate,' 'approximately,' 'about,' etc., as used herein indicate a deviation of within +/−10%. Relationships between the various elements of the disclosed device as described herein are presented as illustrative examples only, and not intended to limit the scope or nature of the relationships between the various elements. Persons of ordinary skill in the art may appreciate that numerous design configurations may be possible to enjoy the functional benefits of the inventive systems. Thus, given the wide variety of configurations and arrangements of embodiments of the present invention the scope of the invention is reflected by the breadth of the claims below rather than narrowed by the embodiments described above.

What is claimed is:

1. A portable foot washer, comprising:

a reservoir including a reservoir floor and a surrounding side wall extending upwards from the reservoir floor and forming an enclosure configured to hold a liquid;

a top wall extending into the reservoir enclosure past an inner top edge of the surrounding side wall of the reservoir, the top wall including an opening through which a user's foot can be inserted into the reservoir;

a spring supported footbed housed within the enclosure of the reservoir and configured to receive said user's foot; and a drain floor including a drain floor opening, the drain floor being supported atop the reservoir floor and configured to trap particles contained in liquid within the reservoir, wherein a narrow gap is provided between a surrounding side wall of the footbed and the surrounding side wall of the reservoir, wherein, when pressed down by the user's foot, the footbed is configured to impose pressure on liquid contained within said reservoir, forcing said liquid through the narrow gap, such that said liquid hits an underside of the top wall extending into the reservoir enclosure and is directed back down on the user's foot, said user's foot being positioned atop the footbed, wherein a plurality of springs are captured between an underside of the footbed and a top surface of the drain floor via spring retaining members, and wherein the surrounding side wall of the footbed includes vertical ridges configured to engage within guide channels provided on an inner surface of the surrounding side wall of the reservoir.

2. The portable foot washer of claim 1, wherein the drain floor is supported atop the reservoir floor via raised posts that extend upwards from the reservoir floor and mate within cylindrical hollows formed within an underside of the drain floor.

3. The portable foot washer of claim 1, wherein the footbed includes at least one drain hole configured to prevent water from collecting on top of the footbed.

4. The portable foot washer of claim 1, wherein the underside of the top wall has a curvature.

5. The portable foot washer of claim 1, wherein the top wall is provided within a removable top rim configured to cap the reservoir, the top rim providing a top opening in the foot washer for receiving the user's foot.

6. The portable foot washer of claim 1, wherein said spring retaining members comprise spring receiving slots formed at the underside of the footbed and spring posts extending upwards from the top surface of the drain floor.

7. The portable foot washer of claim 1, the foot washer device comprising 4 springs which are evenly distributed in a quadrilateral configuration, to evenly balance the force imposed on the footbed by the user's foot.

* * * * *